US011066767B2

(12) United States Patent
Tachikawa et al.

(10) Patent No.: US 11,066,767 B2
(45) Date of Patent: Jul. 20, 2021

(54) SEWING MACHINE

(71) Applicant: JUKI CORPORATION, Tama (JP)

(72) Inventors: Mitsuhiro Tachikawa, Tama (JP); Ngoc Khanh Ho, Tama (JP); Masahiko Okamura, Tama (JP)

(73) Assignee: JUKI CORPORATION, Tama (JP)

( * ) Notice: Subject to any disclaimer, the term of this patent is extended or adjusted under 35 U.S.C. 154(b) by 171 days.

(21) Appl. No.: 16/416,388

(22) Filed: May 20, 2019

(65) Prior Publication Data

US 2019/0352823 A1 Nov. 21, 2019

(30) Foreign Application Priority Data

May 21, 2018 (JP) ..... JP2018-097330

(51) Int. Cl.

| | |
|---|---|
| ***D05B 29/02*** | (2006.01) |
| ***D05B 19/08*** | (2006.01) |
| ***D05B 29/08*** | (2006.01) |
| ***D05B 19/10*** | (2006.01) |
| ***D05B 19/16*** | (2006.01) |
| ***D05B 27/04*** | (2006.01) |
| ***D05B 31/00*** | (2006.01) |

(52) U.S. Cl.

CPC ..... *D05B 19/08* (2013.01); *D05B 19/10* (2013.01); *D05B 19/16* (2013.01); *D05B 27/04* (2013.01); *D05B 29/02* (2013.01); *D05B 29/08* (2013.01); *D05B 31/00* (2013.01); *D05D 2205/04* (2013.01)

(58) Field of Classification Search

CPC ..... D05B 29/02; D05B 29/06; D05B 27/04; D05B 31/00; D05B 19/08; D05B 19/16

See application file for complete search history.

(56) References Cited

U.S. PATENT DOCUMENTS 3,970,017 A * 7/1976 Babson ..... D05B 35/102 112/470.07
4,363,281 A * 12/1982 Reinke ..... D05B 27/04 112/272
4,704,978 A * 11/1987 Nomura ..... D05B 19/00 112/239

(Continued)

FOREIGN PATENT DOCUMENTS

JP 2010-148550 A 7/2010

*Primary Examiner* — Tajash D Patel

(74) *Attorney, Agent, or Firm* — Faegre Drinker Biddle & Reath LLP

(57) ABSTRACT

A sewing machine includes: a needle vertical movement mechanism which moves a sewing needle; a moving mechanism which holds a workpiece by a holding frame; an inner presser-foot device which moves an inner presser foot on an upper side of the workpiece held by the holding frame; a control device which controls the moving mechanism based on sewing data in which stitch positions are defined in order in a series of sewing; and a height detector which detects a height of the inner presser foot. The control device lowers the inner presser foot to an upper surface of the workpiece held by the holding frame, detects the height of the inner presser foot by the height detector, and determines suitability of a thickness of the workpiece, at one or plural stitch positions defined in the sewing data before starting the sewing in accordance with the sewing data.

5 Claims, 10 Drawing Sheets

(56) References Cited

U.S. PATENT DOCUMENTS

| | | | | |
|---|---|---|---|---|
| 4,869,187 | A * | 9/1989 | Little | D05B 29/02 112/475.01 |
| 5,461,997 | A * | 10/1995 | Landen | D05B 29/02 112/237 |
| 2015/0122165 | A1* | 5/2015 | Maki | D05B 37/063 112/470.05 |
| 2019/0040558 | A1* | 2/2019 | Shiraishi | D05B 69/18 |
| 2019/0353476 | A1* | 11/2019 | Takeda | G01B 11/2513 |

* cited by examiner

FIG. 9

| | | FIRST SET VALUE | SECOND SET VALUE |
|---|---|---|---|
| FIRST SEWING PATTERN | HEIGHT OF INNER PRESSER FOOT | 6 | 0 |
| | SEWING | 20 | 30 |
| | SEWING | 20 | 28 |
| | SEWING | 20 | 26 |
| | SEWING | 20 | 24 |
| | ⋮ | ⋮ | ⋮ |
| | SEWING | 14 | 30 |
| | SEWING | 16 | 30 |
| | SEWING | 18 | 30 |
| | SEWING | 20 | 30 |
| | THREAD CUTTING | | |
| SECOND SEWING PATTERN | HEIGHT OF INNER PRESSER FOOT | 9 | 0 |
| | SEWING | 16 | -4 |
| | SEWING | 16 | -6 |
| | SEWING | 16 | -8 |
| | SEWING | 16 | -10 |
| | ⋮ | ⋮ | ⋮ |
| | SEWING | 10 | -4 |
| | SEWING | 12 | -4 |
| | SEWING | 14 | -4 |
| | SEWING | 16 | -4 |
| | THREAD CUTTING | | |
| THIRD SEWING PATTERN | HEIGHT OF INNER PRESSER FOOT | 12 | 0 |
| | SEWING | 10 | -16 |
| | SEWING | 10 | -18 |
| | SEWING | 10 | -20 |
| | SEWING | 10 | -22 |
| | ⋮ | ⋮ | ⋮ |
| | SEWING | 4 | -16 |
| | SEWING | 6 | -16 |
| | SEWING | 8 | -16 |
| | SEWING | 10 | -16 |
| | THREAD CUTTING | | |
| | END | | |

SEWING MACHINE

CROSS-REFERENCE TO RELATED APPLICATIONS

This application is based upon and claims the benefit of priority from Japanese Patent Application No. 2018-097330, filed on May 21, 2018; the entire contents of which are incorporated herein by reference.

TECHNICAL FIELD

The present invention relates to a sewing machine including an inner presser foot.

BACKGROUND ART

As a sewing machine that performs sewing in accordance with sewing data in which each stitch position is recorded for a series of sewing including any one or a plurality of sewing patterns in which the stitch positions are defined for each stitch point, a so-called electronic cycle sewing machine is known.

Since the electronic cycle sewing machine arbitrarily moves a holding frame for holding a workpiece along a horizontal surface to be positioned and performs the sewing, an inner presser foot is provided instead of a presser foot in a state of pressing the workpiece during the sewing similar to a so-called lockstitch sewing machine.

The inner presser foot vertically moves with a smaller stroke than that of a sewing needle at a height not reaching a throat plate so as not to inhibit the workpiece that moves in the holding frame, suppresses flapping of the workpiece, and can smoothly pull out the sewing needle to be raised from the workpiece (for example, refer to JP-A-2010-148550).

SUMMARY OF INVENTION

However, for example, in a case where the sewing is performed by stacking a plurality of workpieces such as an airbag, the number of workpieces to be sewn may vary depending on the stitch position.

In this case, the sewing is performed while the holding frame holds a plurality of workpieces in a stacked state in a predetermined arrangement. But, when the workpiece arrangement is incorrect when setting the workpiece in the holding frame, or when some workpieces have been forgotten to be stacked, there may be defective products.

Suppression and reduction of such defective products have been required at the sewing site.

An object of the invention is to perform proper sewing.

(1) A sewing machine includes a needle vertical movement mechanism, a moving mechanism, an inner presser-foot device, a control device and a height detector. The needle vertical movement mechanism is configured to vertically move a sewing needle. The moving mechanism is configured to hold a workpiece by a holding frame to move the held workpiece. The inner presser-foot device is configured to vertically move an inner presser foot on an upper side of the workpiece held by the holding frame. The control device is configured to control the moving mechanism based on sewing data in which stitch positions are defined in order in a series of sewing. The height detector is configured to detect a height of the inner presser foot. The control device lowers the inner presser foot to an upper surface of the workpiece held by the holding frame, detects the height of the inner presser foot by the height detector, and determines suitability of a thickness of the workpiece, at one or a plurality of stitch positions defined in the sewing data before starting the sewing in accordance with the sewing data.

(2) In the sewing machine according to (1), the height detector includes a magnetic sensor.

(3) In the sewing machine according to (1) or (2), the sewing data includes information on the thickness of the workpiece, and the control device checks the height of the inner presser foot detected by the height detector with the information on the thickness of the workpiece of the sewing data to determine suitability of the thickness of the workpiece.

(4) In the sewing machine according to (3), the series of sewing based on the sewing data includes a plurality of sewing patterns, the sewing data includes information on the thickness of the workpiece for each of the sewing patterns, and the control device lowers the inner presser foot to an upper surface of the workpiece held by the holding frame, detects the height of the inner presser foot by the height detector, and determines suitability of the thickness of the workpiece, at one or a plurality of locations for each of the sewing patterns.

According to the invention, it is possible to suppress and reduce defective products and to perform proper sewing by lowering the inner presser foot to the upper surface of the workpiece held by the holding frame, detecting the height of the inner presser foot by the height detector, and determining suitability of the thickness of the workpiece, before starting the sewing in accordance with the sewing data.

BRIEF DESCRIPTION OF DRAWINGS

FIG. 9 is an explanatory view illustrating a data configuration of sewing data.

DESCRIPTION OF EMBODIMENTS

Outline of Embodiment

Hereinafter, an embodiment of a sewing machine according to the invention will be described in detail with reference to the drawings.

In the embodiment, an electronic cycle sewing machine will be described as an example of the sewing machine.

Figure 1:
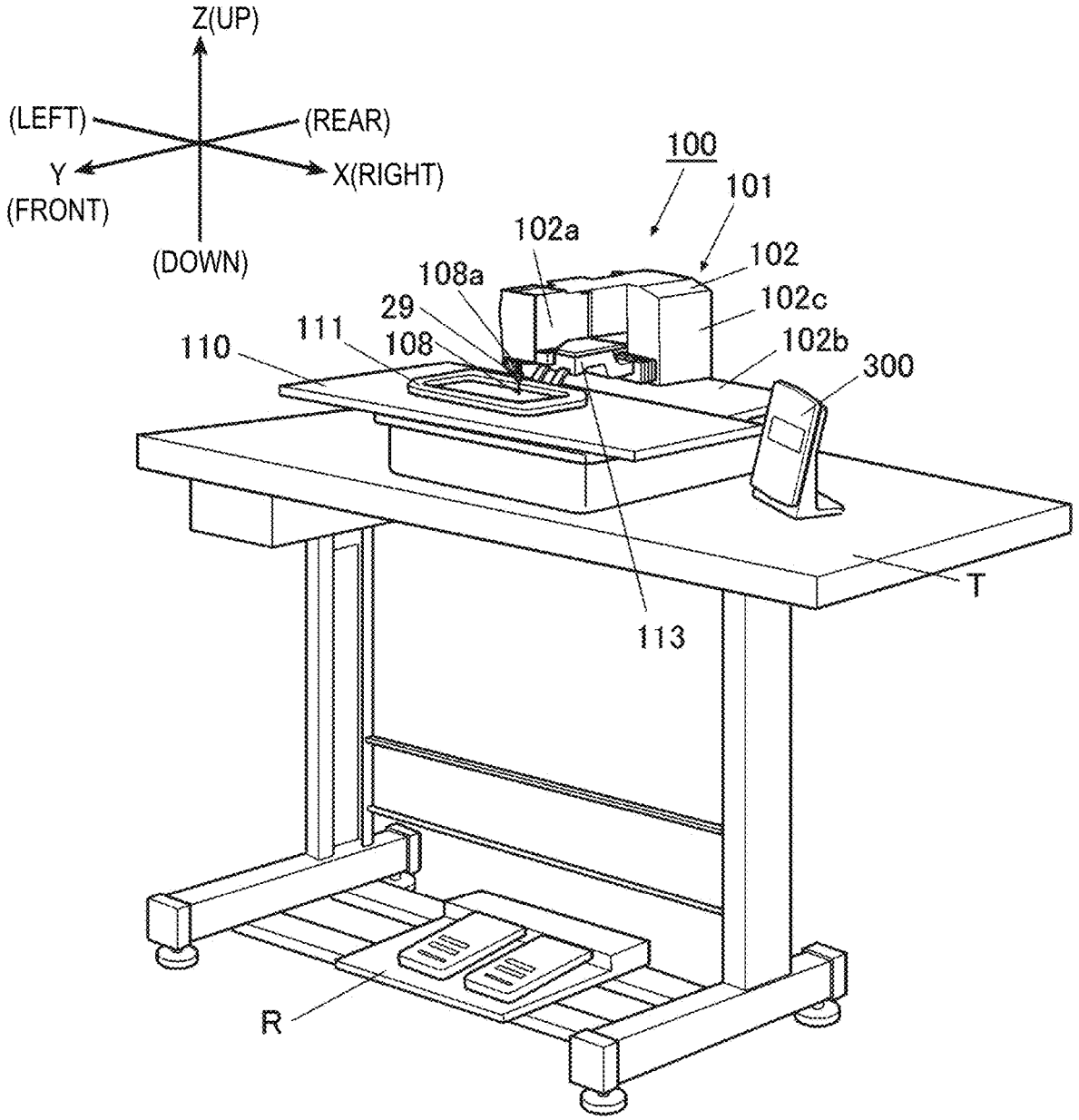
FIG. 1 is a perspective view illustrating a sewing machine according to the present invention.
Figure 2:
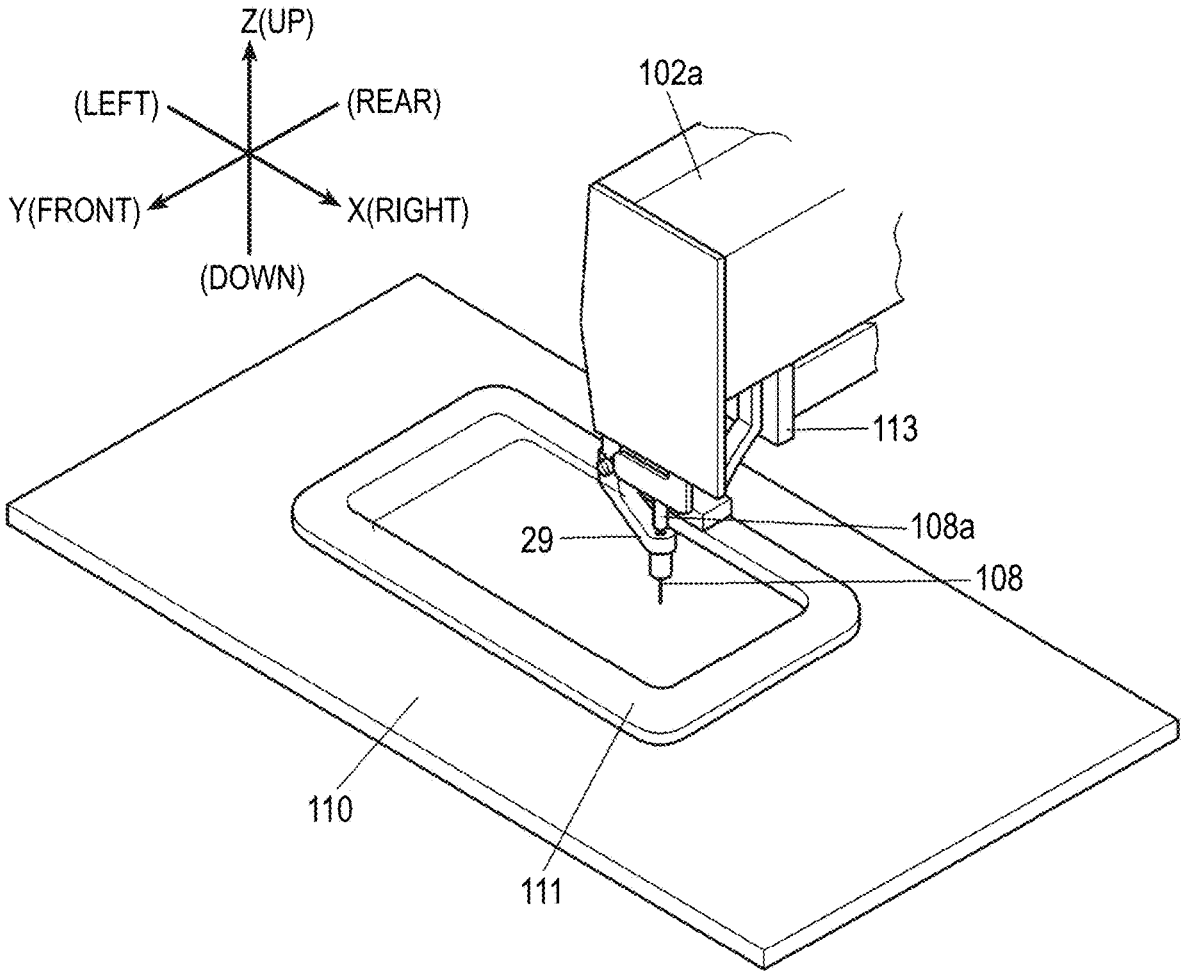
FIG. 2 is an enlarged perspective view illustrating a vicinity of a holding frame and an inner presser foot of the sewing machine.

FIG. 1 is a perspective view of a sewing machine 100, and FIG. 2 is an enlarged perspective view around a sewing needle.

The electronic cycle sewing machine is a sewing machine which includes a holding frame for holding a plurality of stacked workpieces, and forms seams based on predetermined sewing data on a plurality of workpieces held by the holding frame as the holding frame moves relative to a sewing needle.

Here, a direction in which a sewing needle 108 which will be described later vertically moves is referred to as a Z-axis direction (up-down direction), a direction orthogonal to the Z-axis direction is referred to as an X-axis direction (left-right direction), and a direction orthogonal to both the Z-axis direction and the X-axis direction is referred to as a Y-axis direction (front-rear direction).

As illustrated in FIG. 1, the electronic cycle sewing machine 100 (hereinafter, referred to as the sewing machine 100) includes a main body 101 provided on an upper surface of a table T, a pedal R which operates the main body 101 provided in a lower portion of the table T, and an operation panel 300 provided in an upper portion of the table T to perform an input operation by a user.

Frame and Main Shaft

As illustrated in FIGS. 1 and 2, the main body 101 is provided with a frame 102 of which an outer shape is substantially U-shaped in a side view. The frame 102 includes: an arm portion 102*a* that is an upper portion of the main body 101 and extends in the Y-axis direction; a bed portion 102*b* that is a lower portion of the main body 101 and extends in the Y-axis direction; and an upright drum portion 102*c* that connects the arm portion 102*a* and the bed portion 102*b* to each other.

In the main body 101, a power transmission mechanism is disposed in the frame 102, and includes a main shaft and a lower shaft (both are not illustrated) which are freely rotatable and extend in the Y-axis direction. The main shaft is rotatably supported on the inside of the arm portion 102*a*, and the lower shaft (not illustrated) is rotatably supported on the inside of the bed portion 102*b*.

The main shaft is connected to a motor 2*a* (refer to FIG. 7), and a rotational force is applied by the motor 2*a*. In addition, the lower shaft (not illustrated) is connected to the main shaft via a timing belt and a gear (not illustrated). When the main shaft rotates, the power of the main shaft is transmitted to the lower shaft axis via the timing belt and the gear, and the lower shaft rotates at double speed of the main shaft.

A shuttle device (not illustrated) is provided at a front end of the lower shaft (not illustrated). When the lower shaft rotates together with the main shaft, the seams are formed by the cooperation of the sewing needle 108 and an outer shuttle (not illustrated) of the shuttle device.

The shuttle device includes the outer shuttle fixedly mounted to a front end portion of the lower shaft and an inner shuttle that uses a bobbin inside the outer shuttle. Since the configuration of the shuttle device is similar to that of a related shuttle device and will not be described in detail here.

Needle Vertical Movement Mechanism

In the front end portion of the arm portion 102*a*, a needle bar 108*a* that holds the sewing needle 108 in a lower end portion is supported to be vertically movable. Inside the front end portion of the arm portion 102*a*, a needle bar crank fixedly mounted at the front end of the main shaft, a needle bar holder fixedly mounted to the needle bar 108*a*, and a crank rod that connects the needle bar crank and the needle bar holder to each other, are provided.

The needle bar crank rotates together with the main shaft. One end portion of the crank rod is connected onto a periphery of the rotation of the needle bar crank to be rotatable around the Y-axis, and the other end portion of the crank rod is connected to the needle bar holder around the Y-axis. Therefore, when the main shaft rotates by the motor 2*a*, the one end portion of the crank rod performs an orbiting motion, only a vertical movement which is a Z-axis direction component of the orbiting motion is transmitted to the other end portion of the crank rod, and the vertical movement can be applied to the needle bar 108*a*.

In other words, the motor 2*a*, the main shaft, the needle bar crank, the needle bar holder, the crank rod, and the needle bar 108*a* serves a needle vertical movement mechanism which vertically moves the sewing needle 108.

In addition, since the needle vertical movement mechanism is a mechanism related to a well-known configuration, any of the configurations will be omitted in the drawing.

Moving Mechanism

As illustrated in FIGS. 1 and 2, a throat plate 110 is disposed on the bed portion 102*b*, and a holding frame 111 that serves as a cloth holding portion is disposed on the upper side of the throat plate 110.

Figure 7:
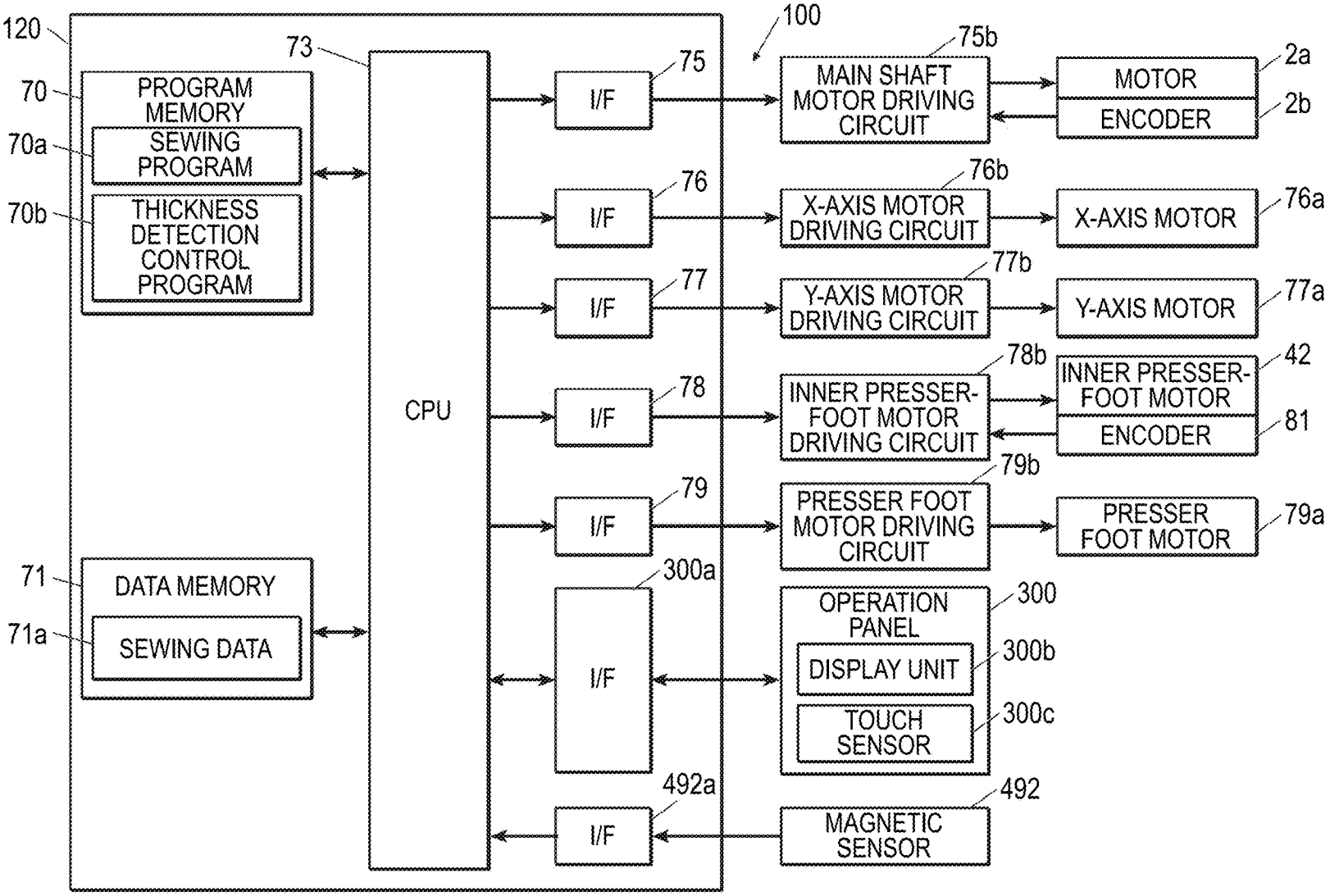
FIG. 7 is a block diagram illustrating a control system of the sewing machine.

The holding frame 111 is attached to an attachment member 113 disposed on the lower side of the arm portion 102*a*, and an X-axis motor 76*a* and a Y-axis motor 77*a* are connected to the attachment member 113 via a belt mechanism (not illustrated) disposed in the bed portion 102*b* (refer to FIG. 7).

The holding frame 111 sandwiches the workpiece and moves the held workpiece in the front-rear and left-right directions in accordance with the driving of the X-axis motor 76*a* and the Y-axis motor 77*a*. In addition, the movement of the holding frame 111 is interlocked with the operation of the sewing needle 108 or the shuttle (not illustrated), and accordingly, seams are formed based on a plurality of stitch positions recorded in the predetermined sewing data in the workpiece.

The holding frame 111 includes a presser foot and a lower plate.

In addition, the attachment member 113 supports the presser foot of the holding frame 111 to be capable of being raised and lowered, and gives a raising and lowering operation to the presser foot by driving a presser foot motor 79*a* disposed in the arm portion 102*a*. The presser foot is configured to sandwich and hold the workpiece with the lower plate by a downward movement.

In addition, the holding frame 111, the attachment member 113, the belt mechanism, the X-axis motor 76*a*, the Y-axis motor 77*a*, the presser foot motor 79*a* and the like function as moving mechanisms which move and position the workpiece in any manner along the X-axis direction and the Y-axis direction.

Pedal

The pedal R operates as an operation pedal to drive the sewing machine 100, and to vertically move the needle bar 108*a* and the sewing needle 108 and for operating the holding frame 111.

A sensor is incorporated in the pedal R to detect a pedaling operation position of the pedal R at which the pedal R performs pedaling, and an output signal from the sensor is input into a control device 120 which will be described later as an operation signal of the pedal R.

The control device 120 drives the sewing machine 100 and controls execution of each of other operations according to the operation signal that corresponds to the operation position.

Operation Panel

Further, the sewing machine 100 is provided with the operation panel 300 to perform the operation input by the user, and various data or operation signals input into the operation panel 300 is input into the control device 120 which will be described later.

In addition, the operation panel 300 includes a display unit 300*b* including a liquid crystal display panel and a touch sensor 300*c* provided on a display screen of the display unit 300*b*, and by performing a touch operation with various operation keys or the like displayed on the liquid crystal display panel, detects a position at which a touch instruction is given on the touch panel, and outputs the operation signal that corresponds to the detected position to the control device 120 which will be described later.

Inner Presser-Foot Device

Figure 3:
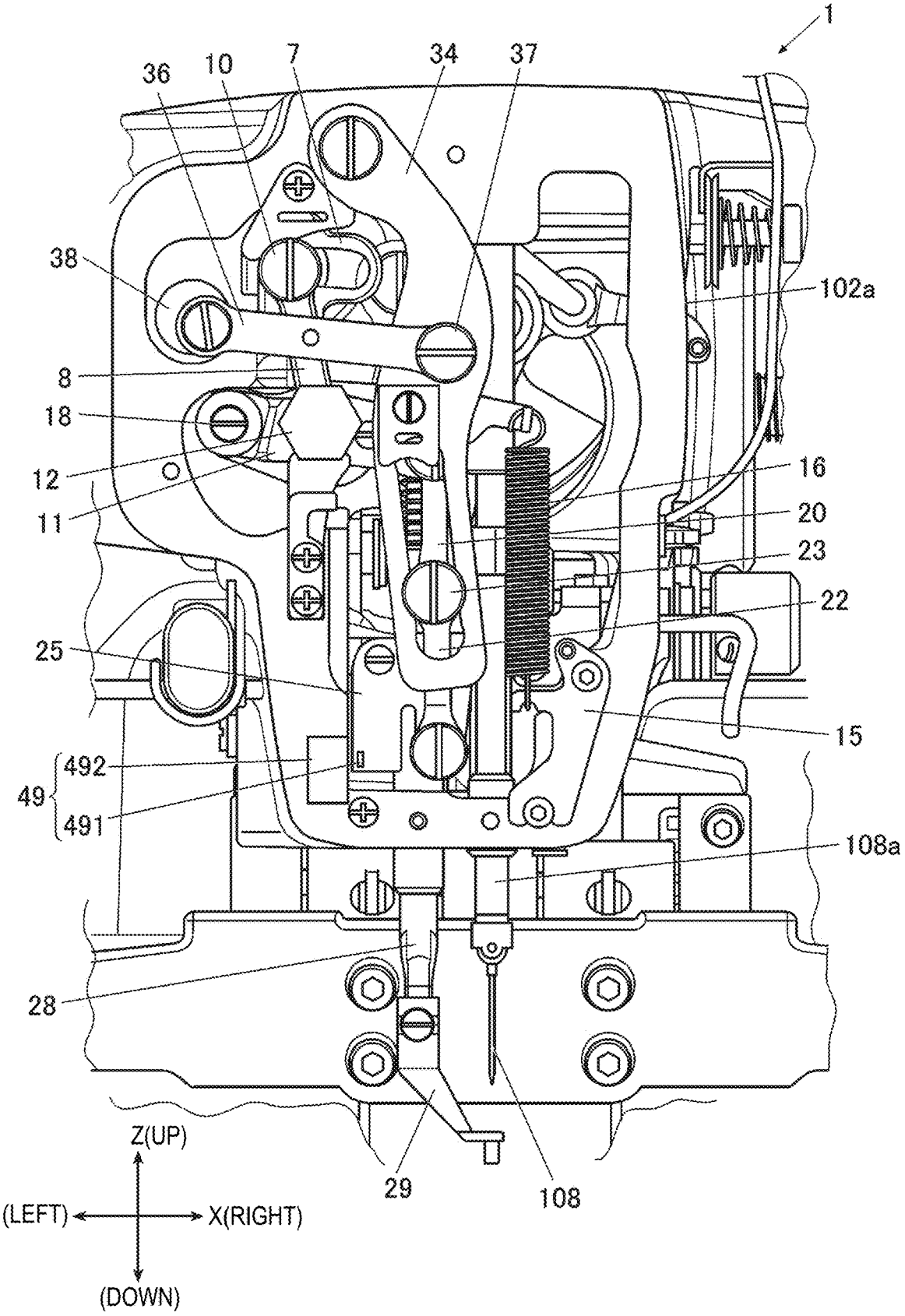
FIG. 3 is a front view of an inner presser-foot device within an arm portion.
Figure 4:
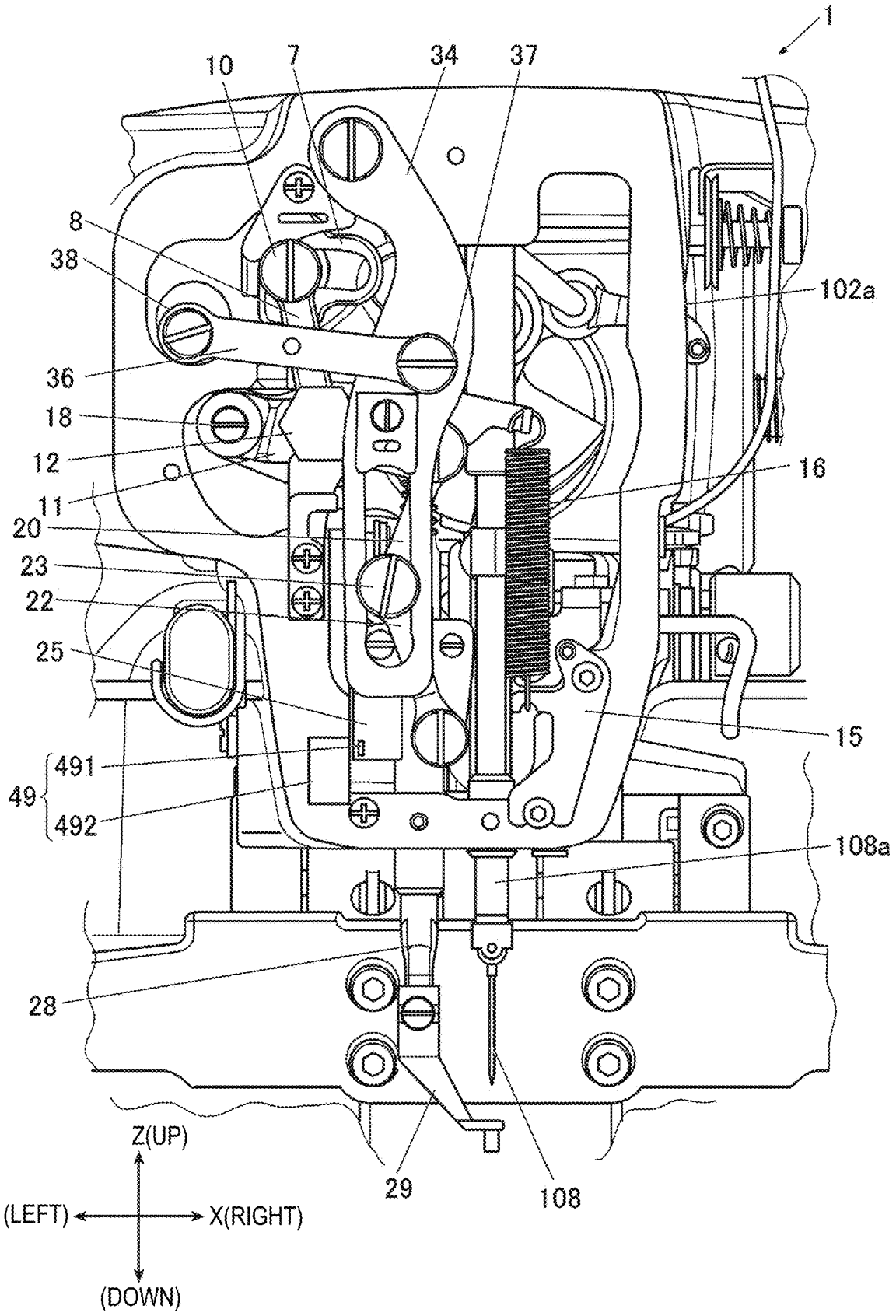
FIG. 4 is a front view of the inner presser-foot device in the arm portion, and illustrates a state where the inner presser foot is adjusted to be higher than that in FIG. 3.
Figure 5:
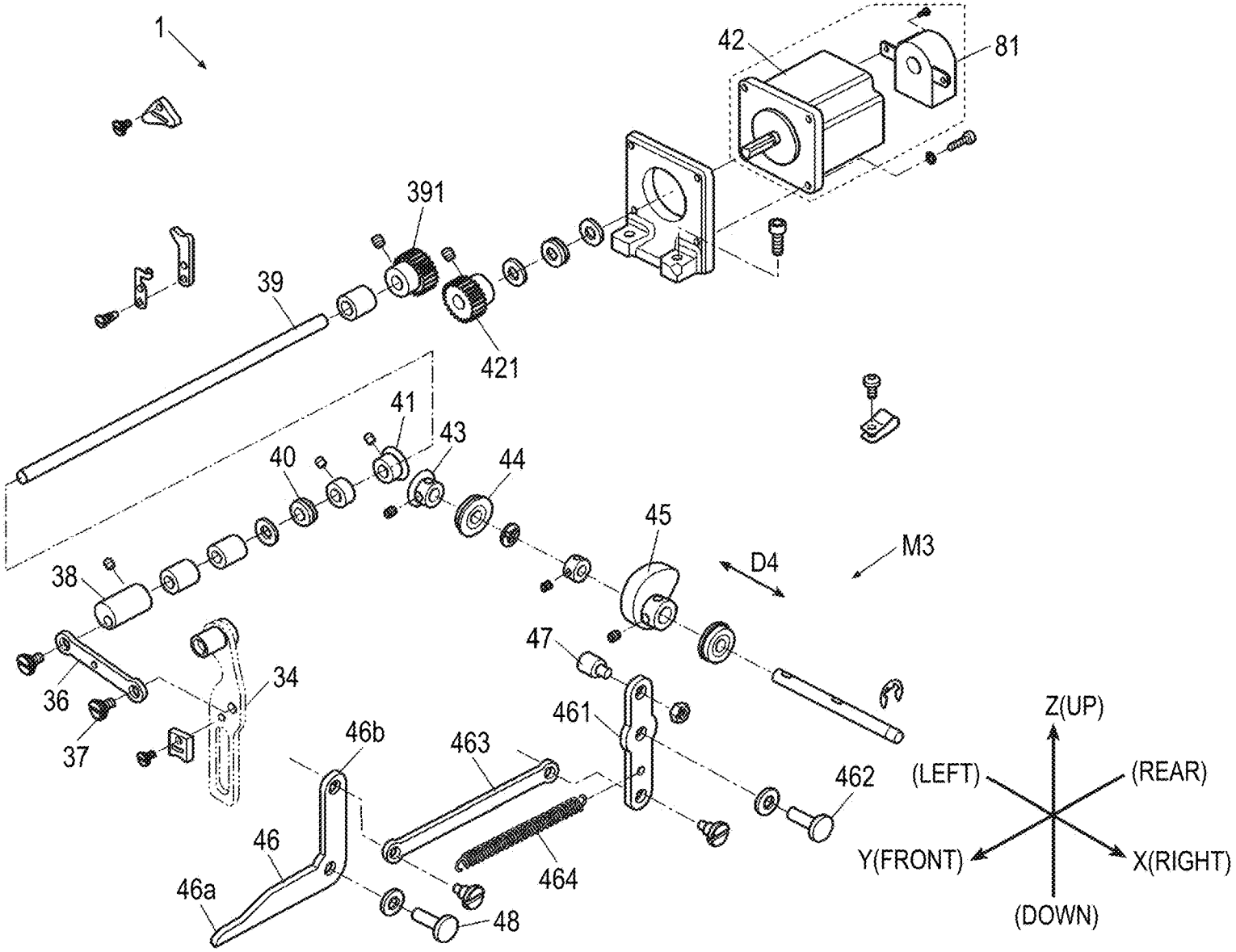
FIG. 5 is an exploded perspective view illustrating a configuration of a part of the inner presser-foot device.
Figure 6:
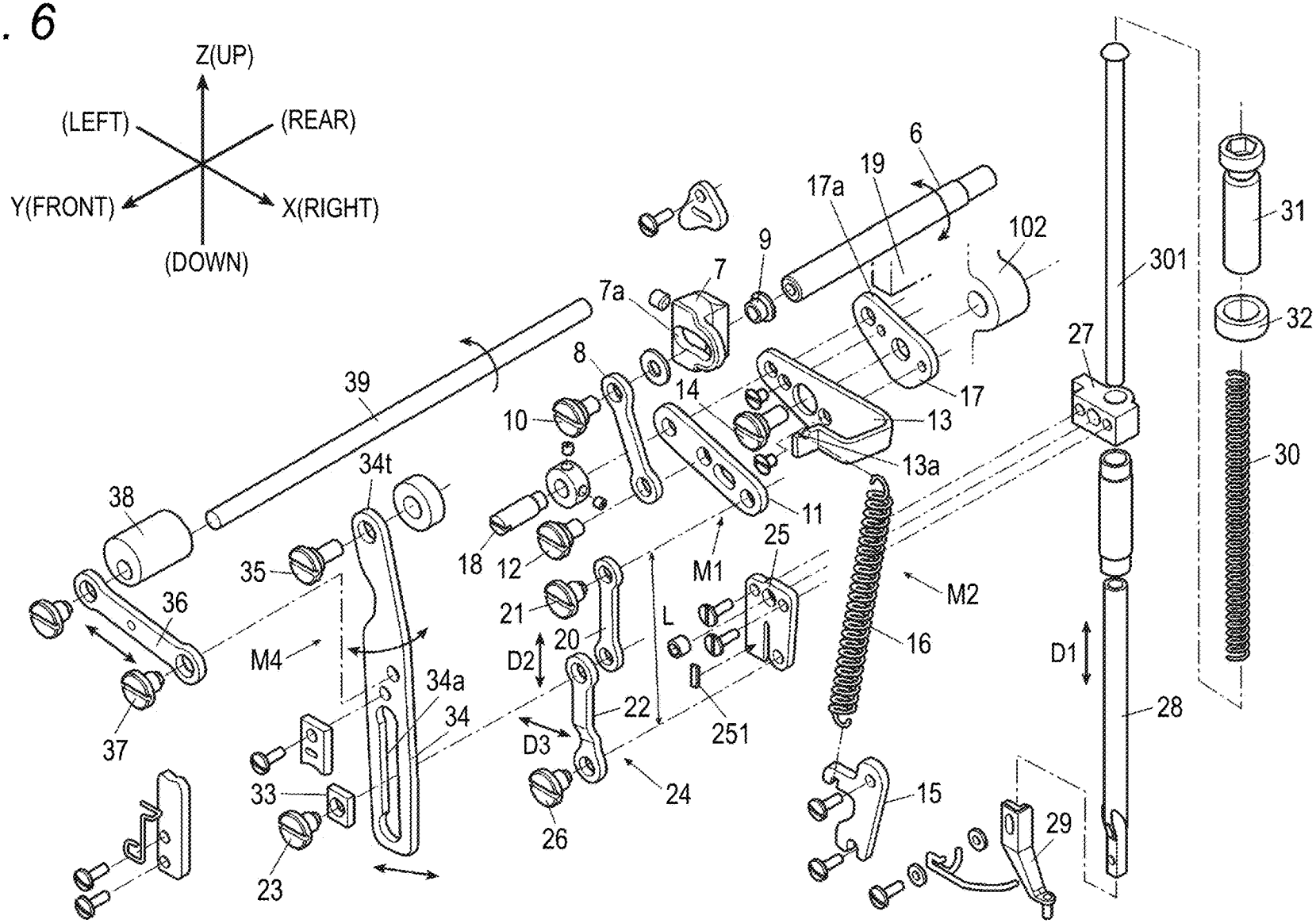
FIG. 6 is an exploded perspective view illustrating a configuration of another part of the inner presser-foot device.

FIGS. 3 and 4 are front views of an inner presser-foot device 1 in the arm portion 102*a*, FIG. 5 is an exploded perspective view illustrating a configuration of a part of the inner presser-foot device 1, and FIG. 6 is an exploded perspective view illustrating a configuration of a remaining part of the inner presser-foot device 1.

The inner presser-foot device 1 includes, in the front end portion of the arm portion 102*a*, an inner presser foot 29 which vertically moves in conjunction with the vertical movement of the needle bar 108*a* in order to prevent the floating of the workpiece due to the vertical movement of the sewing needle 108, and presses the upward flapping of the workpiece around the sewing needle 108. In addition, the main body of the inner presser-foot device 1 is disposed on the inside of the arm portion 102*a*, and the inner presser foot 29 is disposed below the front end portion of the arm portion 102*a*. In addition, the inner presser foot 29 includes a circular frame, and the sewing needle 108 is loosely inserted therein.

As illustrated in FIGS. 3 to 6, the inner presser-foot device 1 includes: the inner presser foot 29; an inner presser-foot vertical movement mechanism M1 which vertically moves the inner presser foot 29 according to the sewing needle 108 which vertically moves by the rotation of the main shaft; an overload avoiding mechanism M2 which performs a releasing operation to avoid the overload to the inner presser-foot vertical movement mechanism M1 when the lowering operation of the inner presser foot 29 is inhibited; an inner presser-foot retreating mechanism M3 which raises the inner presser foot 29 to a retreat position; and an inner presser-foot height adjustment mechanism M4 which adjusts the overall height of the operation range of the vertical movement of the inner presser foot 29 by the motor 2*a*.

Inner Presser-Foot Device: Inner Presser-Foot Vertical Movement Mechanism

The inner presser-foot vertical movement mechanism M1 obtains the power of the vertical movement of the inner presser foot 29 from the rotation of the main shaft of the needle vertical movement mechanism.

In other words, the inner presser-foot vertical movement mechanism M1 includes a reciprocating operation mechanism including an eccentric cam provided on the main shaft; a connecting rod which rotatably holds the eccentric cam at one end portion of the connecting rod; a swinging shaft 6 along the Y-axis direction to perform reciprocating rotation; and a swinging arm that extends from the swinging shaft 6 in the Z-axis direction.

The other end portion of the connecting rod is connected to an extending end portion of the swinging arm to be rotatable around the Y-axis. Accordingly, when the main shaft rotates fully, the one end portion of the connecting rod performs an orbiting operation around the Y-axis by the eccentric cam, and the other end portion of the connecting rod moves forward along the X-axis direction. In addition, the forward movement along the X-axis direction is also transmitted to the extending end portion of the swinging arm, and the swinging shaft 6 that pivotally supports the swinging arm reciprocates in the same cycle as the rotation of the main shaft.

In addition, since the reciprocating motion mechanism using the eccentric cam is a related mechanism, each configuration except for the swinging shaft 6 will be omitted in the drawing.

Furthermore, as illustrated in FIG. 6, a base end portion of the inner presser-foot adjusting arm 7 is fixed to the other end portion of the swinging shaft 6 to adjust the moving amount in an up-down direction D1 of the inner presser foot 29. A cam groove 7*a* is formed in the inner presser-foot adjusting arm 7. The cam groove 7*a* is an arc-shaped long hole, and the upper end portion of a first link 8 is pivotally supported by an adjustment nut 9 and a step screw 10 around the Y-axis at a desired position of the cam groove 7*a*. The fixed position of the upper end portion of the first link 8 is adjustable to move toward and away from the center of the swinging shaft 6, and can adjust increase and decrease of the reciprocating amount given to the first link 8 in proportion to the distance from the center, that is, the amount of the vertical movement of the inner presser foot 29.

As illustrated in FIG. 6, the lower end portion of the first link 8 is connected to a substantially intermediate portion in a longitudinal direction of a second link 11 to be rotatable around the Y-axis by the step screw 12. Here, the cam groove 7*a* with which the adjustment nut 9 engages is formed to be a part of an arc centered on the shaft center of the step screw 12 when the inner presser foot 29 is at a bottom dead point of the vertical reciprocating motion. In other words, by adjusting the position of the first link 8 in the cam groove 7*a*, it is possible to perform the stroke adjustment in a state where the bottom dead point position of the inner presser foot 29 is fixed.

In addition, a left end portion of the second link 11 is pivotally supported around the Y-axis by the step screw 18 with respect to a positioning link 13 which will be described later.

In addition, as illustrated in FIG. 6, a right end portion of the second link 11 is connected to an upper end portion of a third link 20 to be rotatable around the Y-axis by a step screw 21. An upper end portion of a fourth link 22 is connected to the lower end portion of the third link 20 to be rotatable around the Y-axis by a step screw 23.

A link relay plate 25 is connected to a lower end portion of the fourth link 22 around the Y-axis by a step screw 26. An inner presser-foot bar holder 27 is fixed to the link relay plate 25 and an inner presser-foot bar 28 that extends in the Z-axis direction is held by the inner presser-foot bar holder 27. An inner presser foot 29 which suppresses the rise of the workpiece during the sewing is attached to the lower end portion of the inner presser-foot bar 28. The inner presser-foot bar 28 is fixedly equipped with the inner presser-foot bar holder 27. Further, on the upper side of the inner presser-foot bar 28, a bolt 31, a nut 32 and a pressing spring 30 supported by a spring support shaft 301 are provided, and the inner presser-foot bar 28 and the inner presser foot 29 are always pressed downward by the pressing spring 30.

In addition, in the embodiment, the inner presser-foot vertical movement mechanism M1 includes the reciprocating mechanism, the swinging shaft 6, the inner presser-foot adjusting arm 7, the first link 8, the second link 11, the third link 20, the fourth link 22, the inner presser-foot bar holder 27, the inner presser-foot bar 28, the pressing spring 30, the bolt 31, the nut 32, the step screw 37, and the like.

Inner Presser-Foot Device: Inner Presser-Foot Height Adjustment Mechanism

The above-described step screw 23 connects the third link 20 and the fourth link 22 together with a square die 33 and a guide member 34. In other words, the guide member 34 is provided on the front side of the fourth link 22, and the square piece 33 is slidably supported along the longitudinal direction of the guide member 34.

An upper end portion 34*t* of the guide member 34 is supported to be rotatable around the Y-axis in a housing (frame 102) by a step screw 35 in a state where the longitudinal direction is substantially along the Z-axis direction. Therefore, the lower end portion of the guide member 34 swings to the left and right, and the longitudinal direction of the guide member 34 can be inclined to the left and right.

In the vicinity of the lower end portion of the guide member 34, an elongated long hole 34*a* is formed along the longitudinal direction. In the long hole 34*a*, the square die 33 is slidably fitted inside. Therefore, the guide member 34 can move the connecting portion of the third link 20 and the fourth link 22 along the long hole 34*a* through the square die 33.

Furthermore, as illustrated in FIG. 6, the right end portion of a moving link 36 which swings the guide member 34 in the X-axis direction is connected to the guide member 34 to be rotatable around the Y-axis in the vicinity of the upper portion of the long hole 34*a* by the step screw 37. An eccentric cam 38 is connected to the left end portion of the moving link 36, and the eccentric cam 38 is fixedly supported in the front end portion of a variable shaft 39.

The variable shaft 39 is disposed along the Y-axis direction, and is supported to be rotatable around the Y-axis by a bearing 40. In addition, a bevel gear 41 is fixedly provided at a middle part of the variable shaft 39, and a driven wheel 391 is fixedly provided in the rear end portion.

Meanwhile, behind the variable shaft 39, a middle press foot motor 42 with the output shaft facing forward is disposed, and the output shaft is fixedly equipped with a main driving gear 421. The main driving gear 421 meshes with the driven wheel 391 of the variable shaft 39, and can rotate the variable shaft 39 by driving of the inner presser-foot motor 42.

In other words, the driving of the inner presser-foot motor 42 is transmitted in the order of the variable shaft 39, the eccentric cam 38, and the moving link 36, and the moving link 36 rotates the guide member 34.

The inner presser-foot motor 42 can be rotationally driven in a forward and reverse direction, and the amount of rotation and the timing of the driving can be controlled by the controller 120.

In addition, the inner presser-foot motor 42 is also provided with an encoder 81 to detect a shaft angle of the output shaft. The encoder 81 is a so-called absolute type, can detect the absolute position of the shaft angle of the output shaft, and does not require an origin sensor. In addition, a configuration may be employed in which an incremental type is used as the encoder 81 and an origin sensor and a pulse counter are provided.

In addition, the inner presser-foot motor 42, the main driving gear 421, the driven gear 391, the variable shaft 39, the eccentric cam 38, the moving link 36, the guide member 34, the square die 33 and the like, function as the inner presser-foot height adjustment mechanism M4 that shifts the overall height within the operation range of the vertical movement of the inner presser foot 29 by the motor 2*a*.

Inner Presser-Foot Device: Overload Avoiding Mechanism

The above-described positioning link 13 is attached to the frame 102 that serves as a housing to be rotatable around the Y-axis by the step screw 14 in the vicinity of the center portion thereof. In addition, the position of the step screw 14 viewed from the Y-axis direction matches the position of the step screw 12 when the inner presser foot 29 is at the bottom dead point.

A spring hook 13*a* is formed in a right end portion of the positioning link 13, and an upper end portion of the tension spring 16 is connected to the spring hook 13*a*, and a lower end portion of the tension spring 16 is connected to a spring hook 15 fixed to the frame 102. Therefore, the right end portion of the positioning link 13 is always under tension.

In addition, a stopper 17 is stacked and integrally provided on a rear surface side of the positioning link 13, and a restricting member 19 abuts against the upper part of the left end portion of the stopper 17. Therefore, the positioning link 13 is in a state where the left end portion is in pressure contact with the restricting member 19 via the stopper 17 by the lower tension from the tension spring 16 applied to the right end portion, and in a state where the rotation in a clockwise direction centering on the step screw 14 is restricted.

Accordingly, in a case where the inner presser foot 29 is in pressure contact with the workpiece when being lowered since the height of the inner presser foot 29 is adjusted to be extremely low, the right end portion of the positioning link 13 that supports the second link 11 is lifted up against the tension spring 16 and a downward pressing force applied from the first link 8 to the second link 11 can be released.

In other words, the tension spring 16, the spring hook 15, the stopper 17, the positioning link 13, and the restricting member 19 function as the overload avoiding mechanism M2 that can perform the releasing operation to avoid the overload with respect to the inner presser-foot vertical movement mechanism M1 when the lowering operation of the inner presser foot 29 is inhibited.

Inner Presser-Foot Device: Inner Presser-Foot Retreating Mechanism

As illustrated in FIG. 5, a bevel gear 43 meshes with the bevel gear 41, and the driving of the inner presser-foot motor 42 can be output in a rotational direction centering on a direction D4 orthogonal to a shaft direction of the variable shaft 39. A bearing 44, an inner presser-foot raising and lowering cam 45 and the like are connected to the right part of the bevel gear 43 on the same axis along the X-axis direction.

The inner presser-foot raising and lowering cam 45 is an outer peripheral cam. The outer diameter of the outer periphery of the inner presser-foot raising and lowering cam 45 is constant within a range of 180° around the axis (hereinafter, referred to as a keeping portion), and an outer diameter has a shape with a gradual increase within an angle range of the remaining part (hereinafter, referred to as a changing portion).

The inner presser-foot raising and lowering cam 45 vertically raises and lowers one end portion 46*a* of an inner presser-foot lifting member 46 that raises the inner presser foot 29 to the retreat position after the sewing is completed, and a cylindrical roller 47 provided in the upper end portion of a lever member 461 along the Z-axis direction in which the inner presser-foot lifting member 46 is rotated is in sliding contact with the outer periphery of the inner presser-foot raising and lowering cam 45.

The lever member 461 is pivotally supported by a pin 462 in an intermediate portion in the Z-axis direction, and is rotatable around the X-axis.

In addition, the lower end portion of the lever member 461 is connected to the rear end portion of a transmission link 463 along the Y-axis direction to be rotatable around X-axis.

Further, a rear end portion of the tension spring 464 which applies the tension to the front part is connected the vicinity of the lower end portion of the lever member 461, and accordingly, the roller 47 of the upper end portion of the lever member 461 is in pressure contact with the outer periphery of the inner presser-foot raising and lowering cam 45.

The inner presser-foot lifting member 46 has a substantially L-shape when viewed from the X-axis direction, is pivotally supported by a pin 48 in a bent portion, and is rotatable around the X-axis.

The one end portion 46*a* of the inner presser-foot lifting member 46 which locks the link relay plate 25 from below and which raises the inner presser foot 29 extends forward from the bent portion. Further, the other end portion 46*b* of the inner presser-foot lifting member 46 extended upward from the bent portion is connected to the front end portion of the transmission link 463 to be rotatable around X-axis.

With the above-described configuration, when the inner presser-foot motor 42 is driven, the inner presser-foot raising and lowering cam 45 rotates, and when the roller 47 is in sliding contact with the keeping portion of the inner presser-foot raising and lowering cam 45, the overall height of the operation range of the vertical movement of the inner presser foot 29 is shifted in the up-down direction in the inner presser-foot height adjustment mechanism M4. In addition, when the roller 47 is in sliding contact with the changing portion of the inner presser-foot raising and lowering cam 45, the lower end portion of the lever member 461 rotates rearward against the tension spring 464, biases the rotation in the clockwise direction to the inner presser-foot lifting member 46 via the transmission link 463, and pulls up the inner presser foot 29 to the upper retreat position by the one end portion 46*a*.

In other words, the inner presser-foot retreating mechanism M3 includes the bevel gears 41 and 43, the inner presser-foot raising and lowering cam 45, the roller 47, the lever member 461, the transmission link 463, the tension spring 464, the inner presser-foot lifting member 46 and the like.

Height Detector

The sewing machine 100 includes a height detector 49 that detects the height of the inner presser foot 29. As illustrated in FIGS. 3 and 4, the height detector 49 includes a magnet 491 that serves as an object to be detected fixedly mounted on the link relay plate 25 that performs the vertical movement integrally with the above-described inner presser foot 29 and the inner presser-foot bar 28, and a magnetic sensor 492 mounted in the vicinity of the left side of the link relay plate 25 in the front end portion of the arm portion 102*a*.

The magnetic sensor 492 can detect a change in magnitude of the magnetic intensity in the Z-axis direction, and accordingly can detect the height of the magnet 491.

As the magnetic sensor 492, a coil, a Hall element, a magneto-resistive element, a magnetic impedance element or the like can be used.

Operation of Inner Presser Foot when Performing Sewing

Next, an operation of the inner presser-foot vertical movement mechanism M1 of the inner presser-foot device 1 having the above-described configuration will be described.

When the main shaft rotates by the driving of the motor 2*a*, the swinging shaft 6 reciprocatingly rotates by the reciprocating mechanism. Accordingly, the inner presser-foot adjusting arm 7 vertically swings, and the right end portion of the second link 11 swings in a serial direction D2 of the third link 20 and the fourth link 22 via the first link 8, and the third link 20 and the fourth link 22 swing in the serial direction (up-down direction) D2. According to this, since the inner presser-foot bar 28 moves forward in the up-down direction along the up-down direction D1, the inner presser foot 29 moves in the up-down direction in synchronization with the vertical movement of the sewing needle 108.

Adjustment Operation of Height of Inner Presser Foot by Inner Presser-Foot Device Next, an adjustment operation of the height of the inner presser foot 29 by the inner presser-foot height adjustment mechanism M4 of the inner presser-foot device 1 having the above-described configuration will be described.

The driving of the inner presser-foot motor 42 is transmitted to the variable shaft 39 via the main driving gear 421 and the driven gear 391, the variable shaft 39 and the eccentric cam 38 rotate, and the guide member 34 swings generally along the X-axis direction. Accordingly, the bending angle of the third link 20 and the fourth link 22 changes in the connecting portion via the square die 33, and the height of the inner presser foot 29 changes. At this time, since the square die 33 performs the vertical movement along the long hole 34*a* of the guide member 34, while the inner presser foot 29 performs the vertical movement, the overall height of the movement range of the vertical movement of the inner presser foot 29 changes. Therefore, it is possible to adjust the height of the bottom dead point in the vertical movement of the inner presser foot 29 by the inner presser-foot height adjustment mechanism M4.

Control System of Sewing Machine: Control Device

FIG. 7 is a block diagram illustrating a control system of the sewing machine 100.

The sewing machine 100 includes a control device 120 that serves as operation control unit which controls the operation of each of the above-described units. In addition, the control device 120 includes: a program memory 70 in which a sewing program 70*a* and a thickness detection control program 70*b* are stored; a data memory 71 that serves as storage unit in which sewing data 71*a* and various types of setting information (not illustrated) are stored; and a CPU 73 that executes each of the programs 70*a* and 70*b* in the program memory 70.

In addition, the CPU 73 is also connected to the operation panel 300 via an interface 300*a*. The operation panel 300 includes a display unit 300*b* which displays various screens and input buttons, and a touch sensor 300*c* which is provided on the surface of the display unit 300*b* and detects the contact position thereof, and functions as input and output unit of various types of information. The input buttons and the input switches used in the operation panel 300 are all displayed on the display unit 300*b*, and function in the same manner as the touch type buttons and the switches as the input is detected by the touch sensor 300*c*.

In addition, the operation panel 300 also has a function of setting the setting parameters of the sewing data 71*a* in any manner and a function of selecting the desired data from among a plurality of pieces of sewing data 71*a*.

In addition, the CPU 73 is connected, via an interface 75, to a motor driving circuit 75*b* that drives the motor 2*a*, and controls the rotation of the motor 2*a*. In addition, the motor 2*a* includes an encoder 2*b*.

Further, for example, a servo motor can be applied to the motor 2*a*.

In addition, an X-axis motor driving circuit 76*b* and a Y-axis motor driving circuit 77*b* which respectively drive the X-axis motor 76*a* and the Y-axis motor 77*a* that are provided in the holding frame 111 for holding the workpiece to be sewn are connected to the CPU 73 via an interface 76 and an interface 77, and the CPU 73 controls the operation of the holding case 111 in the X-axis direction and in the Y-axis direction.

In addition, an inner presser-foot motor driving circuit 78*b* that drives the inner presser-foot motor 42 for adjusting the position of a top dead point position and the height position of a bottom dead point of the vertical movement of the inner presser foot by the motor 2*a* is connected to the CPU 73 via an interface 78, and the CPU 73 controls the operation of the inner presser-foot device 1. In addition, as described above, the encoder 81 that serves as motor shaft angle detection means is provided in the output shaft of the inner presser-foot motor 42.

In addition, a presser foot motor driving circuit 79*b* that drives the presser foot motor 79*a* for vertically moving the presser foot (not illustrated) is connected to the CPU 73 via an interface 79, and the CPU 73 controls the operation of the presser foot.

In addition, for example, a stepping motor can be applied to the X-axis motor 76*a* and the Y-axis motor 77*a*, the inner presser-foot motor 42, and the presser foot motor 79*a*.

In addition, the magnetic sensor 492 is connected to the CPU 73 via an interface 492*a*, and can detect the height of the inner presser foot 29.

Sewing Data

Figure 8:
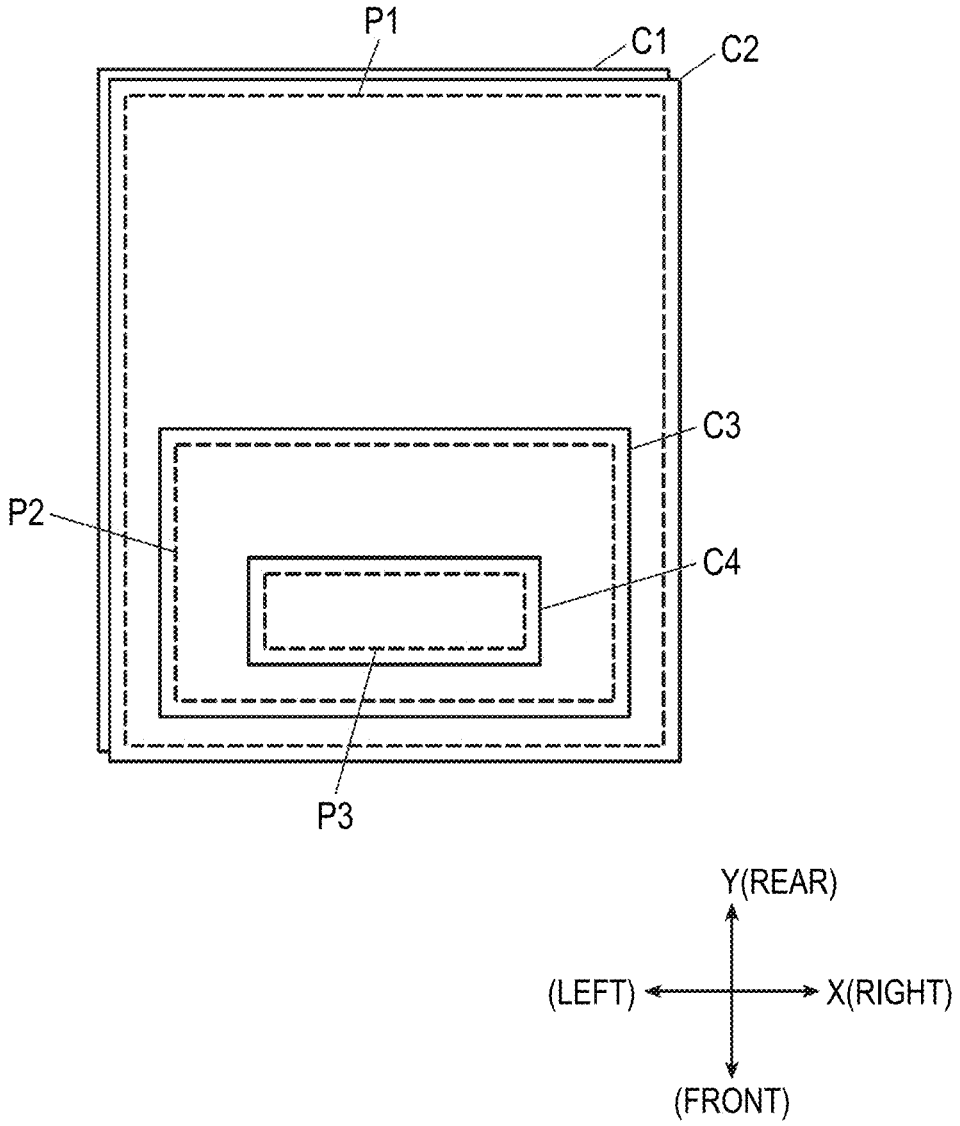
FIG. 8 is a top view illustrating a configuration of a workpiece and a plurality of sewing patterns.

FIG. 8 is a top view of the workpiece illustrating an example of the sewing.

As illustrated in the example of FIG. 8, in a case where the sewing is performed by stacking a plurality of workpieces C1 to C4 having partially different sizes and shapes, there are sections in which the number of workpieces varies in accordance with the stitch positions in the sewing range.

For example, FIG. 9 illustrates an example of the sewing data 71*a* in a case where there is a section in which the number of workpieces varies as described above.

The sewing data 71*a* is data to perform a series of sewing including first to third sewing patterns P1 to P3 in FIG. 8. The sewing pattern P1 is sewn on two workpieces C1 and C2, the sewing pattern P2 is sewn the sewing on three workpieces C1 to C3, and the sewing pattern P3 is sewn the sewing on four workpieces C1 to C4.

In the sewing data 71*a*, various operations executed during the sewing, for example, commands of "change in height of inner presser foot", "movement of workpiece to stitch position", "thread cutting", and the like are recorded in the order of execution. In addition, a thread cutter will be omitted in the drawing.

The height of the inner presser foot 29 is adjusted such that the height of the bottom dead point of the vertical movement of the inner presser foot 29 substantially matches the height of the stacked workpieces.

Therefore, in the sewing data 71*a*, the command of "change in height of inner presser foot" is set such that the height of the bottom dead point of the inner presser foot 29 becomes the height of two workpieces including the workpieces C1 and C2 when starting the sewing of the sewing pattern P1. In addition, thereafter, a movement command of the workpiece indicating the stitch positions in order to sew the sewing pattern P1 is set.

In addition, when starting the sewing of the sewing pattern P2, the command of "change in height of inner presser foot" is set such that the height of the bottom dead point of the inner presser foot 29 becomes the height of three workpieces including the workpieces C1 to C3, and after that, a movement command of the workpiece indicating the stitch positions in order to sew the sewing pattern P2 is set.

Furthermore, when starting the sewing of the sewing pattern P3, the command of "change in height of inner presser foot" is set such that the height of the bottom dead point of the inner presser foot 29 becomes the height of four workpieces including the workpieces C1 to C4, and after that, a movement command of the workpiece indicating the stitch positions in order to sew the sewing pattern P3 is set.

Sewing Control

The CPU 73 of the control device 120 of the sewing machine 100 performs sewing control of the sewing of each of the sewing patterns P1 to P3 by executing the commands defined in the sewing data 71*a* in order based on the sewing program 70*a* in the program memory 70.

For example, in a case where the sewing is performed based on the sewing data 71*a* of FIG. 9, the CPU 73 first controls the inner presser-foot motor 42 such that the height of the bottom dead point of the inner presser foot 29 that vertically moves becomes "6" (the height of two workpieces) in order to perform the sewing with the sewing pattern P1.

Thereafter, the CPU 73 starts the driving of the motor 2*a* and moves each of the workpieces by controlling the X-axis motor 76*a* and the Y-axis motor 77*a* such that the sewing pattern P1 is traced in order at the prescribed main shaft angle of each needle. Then, when the stitching is finished at a final stitch position of the sewing pattern P1, the thread cutting is executed.

In addition, the CPU 73 adjusts the height of the bottom dead point of the inner presser foot 29 to a set value "9" (the height of three workpieces) in order to perform the sewing with the sewing pattern P2, performs the stitching at all of the stitch positions of the sewing patterns P2, and executes the thread cutting.

Similarly, the CPU 73 adjusts the height of the bottom dead point of the inner presser foot 29 to a set value "12" (the height of four workpieces) in order to perform the sewing with the sewing pattern P3, performs the stitching at all of the stitch positions of the sewing patterns P3, and executes the thread cutting.

In this manner, the CPU 73 that executes the sewing program 70*a* controls each configuration of the sewing machine 100 by reading and executing the commands defined in the sewing data 71*a* in order, and executes the sewing in accordance with the sewing pattern included in the sewing data.

Thickness Detection Control

The CPU 73 of the control device 120 of the sewing machine 100 executes thickness detection control for confirming the number of workpieces with respect to some stitch positions of each of the sewing patterns P1 to P3 immediately before executing the sewing by the sewing program 70*a* based on the thickness detection control program 70*b* in the program memory 70.

In the above-described sewing data 71*a*, the height of the bottom dead point of the inner presser foot 29 is set for each of the sewing patterns P1 to P3. The height of the bottom dead point of the inner presser foot 29 set in the sewing data 71*a* is set to a height that substantially matches the height of the upper surface of the top workpiece among the stacked workpieces. Therefore, it is possible to recognize the upper surface height of the workpiece from the height of the bottom dead point of the inner presser foot 29 included in the sewing data 71*a*, that is, the number of stacked workpieces.

As illustrated in FIG. 9, since the height of the bottom dead point of the inner presser foot 29 in the sewing data 71*a* is set for each of the sewing patterns P1 to P3, at the stitch position of any of the sewing patterns P1 to P3, by detecting the thickness of the workpiece with respect to the workpiece held by the holding frame 111 and comparing the detected thickness with the height of the bottom dead point of the inner presser foot 29 in the above-described sewing data, it is possible to determine whether a proper number of workpieces are stacked on each other (whether any of the workpieces C1 to C4 has been forgotten to be inserted or the like).

The thickness of the workpiece can be detected by the magnetic sensor 492 that detects the height of the inner presser foot 29.

Specifically, the CPU 73 of the control device 120 positions the holding frame 111 at the stitch position of any of the sewing patterns P1 to P3, for example, the first stitch position in each of the sewing patterns P1 to P3.

In addition, the inner presser-foot motor 42 is driven to move the presser 29 downward, and the inner presser foot 29 is lowered until the bottom portion touches the workpiece. Therefore, the thickness of the workpiece can be acquired by detecting the height of the inner presser foot 29 at this time with the magnetic sensor 492.

A numerical range obtained by adding or subtracting a predetermined coefficient with respect to the height of the bottom dead point of the inner presser foot 29 defined in the sewing data 71*a* is set as a proper range in consideration of variations of the workpieces. If the height of the inner presser foot 29 detected by the magnetic sensor 492 is not included in the proper range, it is regarded as a state where the number of workpieces is not proper, that is, a state where some workpieces have been forgotten to be input or a deviation is generated in some workpieces, a notification display indicating that the workpiece is not properly set is performed on the display unit 300*b* of the operation panel 300, and the sewing operation is not started and a stop state is set.

Processing by Thickness Detection Control Program

Figure 10:
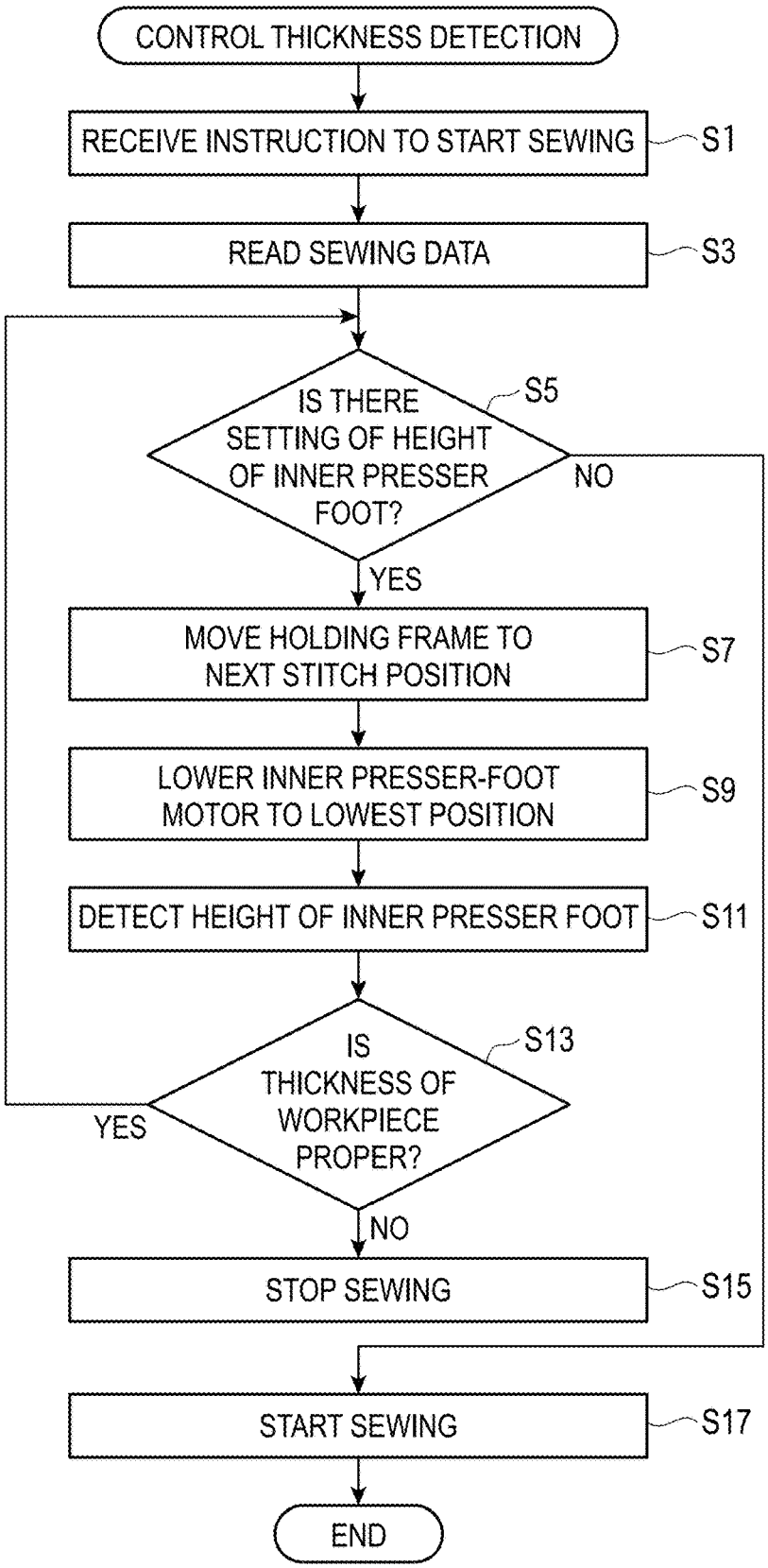
FIG. 10 is a flowchart of a thickness detection control.

Control performed by the CPU 73 with the thickness detection control program 70*b* will be described in detail based on the flowchart of FIG. 10.

First, in a state where the workpieces C1 to C4 are set in the holding frame 111, when an instruction to start the sewing is input (step S1), the CPU 73 of the control device 120 starts reading of the sewing data 71*a* (step S3).

In other words, the CPU 73 reads various sewing operation commands stored in the sewing data 71*a* in order, and searches for the command of "change in height of inner presser foot" (step S5).

In a case where the command of "change in height of inner presser foot" is found (step S5: YES), the CPU 73 reads the stitch positions determined in the command of "movement of workpiece to stitch position" set immediately before the command of "change in height of inner presser foot", and controls the X-axis motor 76*a* and the Y-axis motor 77*a* such that the holding frame 111 is positioned at the stitch position (step S7).

Furthermore, the inner presser-foot motor 42 is driven to move the presser 29 downward, and the inner presser foot 29 is lowered until abutting against the upper surface of the workpiece (step S9).

The height of the inner presser foot 29 when abutting against the workpiece is detected by the magnetic sensor 492 (step S11), it is determined whether the detected height is within the proper range based on the set value of the height of the inner presser foot defined in the command of "change in height of inner presser foot", and it is determined whether the height of the workpiece based on the detected height is proper (step S13).

In the above-described determination, in a case where the detected height of the inner presser foot 29 is within the proper range of the height of the inner presser foot (step S13: YES), the process returns to step S5, and the next command of "change in height of inner presser foot" is searched for.

In addition, in a case where the detected height of the inner presser foot 29 is not within the proper range of the height of the inner presser foot (step S13: NO), the CPU 73 is in a stop state where the notification display indicating that the workpiece is not properly set is performed on the display unit 300*b* of the operation panel 300 and the sewing operation is not started (step S15).

In addition, in step S5, in a case where all the commands in the sewing data 71*a* have been searched for, the process is continued to the sewing control based on the sewing program 70*a*, and the sewing control is executed.

Effects of Embodiment

As described above, in the sewing machine 100, the height detector 49 that detects the height of the inner presser foot 29 is provided, and the control device 120 lowers the inner presser foot 29 to the upper surface of the top workpiece held by the holding frame 111 before starting the sewing in accordance with the sewing data 71*a* by the thickness detection control, detects the height of the inner presser foot 29 by the height detector 49, and determines the suitability of the thickness of the workpiece.

Therefore, in a case of performing the sewing by stacking the plurality of workpieces C1 to C4, and the like, in a case where any one of the workpieces C1 to C4 has been forgotten to be set in the holding frame 111 or in a case where deviation is generated in any of the workpieces C1 to C4, the detection can be performed by the height detector 49.

Accordingly, it becomes possible to effectively detect the forgetting of the setting of the holding case 111 for any one of the workpieces C1 to C4 and the deviation of the workpieces C1 to C4, and it becomes possible to reduce unnecessary sewing.

In addition, since the height detector 49 includes the magnetic sensor 492, compared to a case of optical detection, it is more unlikely to receive influence of lint, dust, dirt, pollution of lubricating oil, and the like in the sewing machine frame 102, and it becomes possible to stably and successfully detect the thickness of a workpiece.

In addition, the sewing data 71*a* includes the command of "change in height of inner presser foot" as information on the thickness of the workpieces C1 to C4.

Accordingly, there is no need to separately prepare the information on the thickness of the workpieces C1 to C4, and it becomes possible to simplify the processing and reduce the information storage capacity.

In addition, the series of sewing based on the sewing data 71*a* includes the plurality of sewing patterns P1 to P3, the sewing data 71*a* includes the setting information of "change in height of inner presser foot" as the information on the thickness of the workpiece for each of the sewing patterns P1 to P3, and the control device 120 lowers the inner presser foot 29 to the upper surface of the workpiece held by the holding frame 111, detects the height of the inner presser foot 29 by the height detector 49, and determines suitability of the thickness of the workpiece, for each of the sewing patterns P1 to P3.

Therefore, it is possible to determine the suitability of the thickness (the number) of each of the workpieces C1 to C4 using the sewing data 71*a* required for the sewing, and it becomes possible to effectively defect the forgetting of the setting of the workpieces C1 to C4 to the holding frame 111 and the deviation of the workpieces C1 to C4 using the existing sewing machine 100. In addition, it is not necessary to newly provide a storage unit for separately storing data on the number and thickness of proper workpieces.

Others

In the above-described thickness detection control based on the thickness detection control program 70*b*, the information on the thickness of the proper workpiece is acquired from the set value of the height of the inner presser foot 29 in the sewing data 71*a*, but the information on the thickness of the workpiece may be prepared in addition to the sewing data 71*a*.

In addition, although the workpiece thickness detection is performed at only one location for each of the sewing patterns P1 to P3, the workpiece thickness detection may be performed at a plurality of locations for each of the sewing pattern P1 to P3.

Furthermore, in the sewing data 71*a*, a case where the thickness of the workpiece is individually set for each of the sewing patterns P1 to P3, and the thickness of the workpiece is constant at each of the stitch positions that configure each of the sewing patterns P1 to P3 is described as an example, but the invention is not limited thereto.

For example, in a case of the sewing data in which there is no distinction by the sewing pattern and in a case of performing "change in height of inner presser foot" one or a plurality of times in the middle of the process of performing the series of sewing determined in the sewing data, since a section from the performance of "change in height of inner presser foot" to the next performance of "change in height of inner presser foot" is a section in which the thickness (number) of the workpiece becomes constant, the suitability may be determined by detecting the number of workpieces for each section and checking the number of workpieces with the set number of workpieces.

In addition, at the height detector 49, the magnet 491 which is the object to be detected is mounted on the link relay board 25, but may be provided on the inner presser foot 29 or another member that vertically moves together with the inner presser foot 29.

Further, the sensor for detecting the object to be detected of the height detector 49 is not limited to the magnetic sensor 492, and various sensors capable of detecting the height of the inner presser foot 29, such as an optical distance sensor, an ultrasonic distance sensor, or a linear sensor or the like, can be used.

What is claimed is:

1. A sewing machine comprising:

a needle vertical movement mechanism that is configured to vertically move a sewing needle;

a moving mechanism that is configured to hold a workpiece having a plurality of layers by a holding frame to move the held workpiece;

an inner presser-foot device that is configured to vertically move an inner presser foot on an upper side of the workpiece held by the holding frame;

a control device that is configured to control the moving mechanism based on sewing data in which stitch positions are defined in order in a series of sewing; and a height detector that is configured to detect a height of the inner presser foot, wherein the control device lowers the inner presser foot to an upper surface of the workpiece held by the holding frame, detects the height of the inner presser foot by the height detector, and determines suitability of a thickness of the workpiece, at one or a plurality of stitch positions defined in the sewing data before starting the sewing in accordance with the sewing data.

2. The sewing machine according to claim 1, wherein the height detector includes a magnetic sensor.

3. The sewing machine according to claim 1, wherein the sewing data includes information on the thickness of the workpiece, and the control device checks the height of the inner presser foot detected by the height detector with the information on the thickness of the workpiece of the sewing data to determine suitability of the thickness of the workpiece.

4. The sewing machine according to claim 2, wherein the sewing data includes information on the thickness of the workpiece, and the control device checks the height of the inner presser foot detected by the height detector with the information on the thickness of the workpiece of the sewing data to determine suitability of the thickness of the workpiece.

5. The sewing machine according to claim 3, wherein the series of sewing based on the sewing data includes a plurality of sewing patterns, the sewing data includes information on the thickness of the workpiece for each of the sewing patterns, and the control device lowers the inner presser foot to an upper surface of the workpiece held by the holding frame, detects the height of the inner presser foot by the height detector, and determines suitability of the thickness of the workpiece, at one or a plurality of locations for each of the sewing patterns.

* * * * *